US005614915A

United States Patent [19]

Webb

[11] Patent Number: 5,614,915

[45] Date of Patent: Mar. 25, 1997

[54] LAYERED ANTENNA

[75] Inventor: Roger C. Webb, Paignton, United Kingdom

[73] Assignee: Northern Telecom Limited, Montreal, Canada

[21] Appl. No.: 626,841

[22] Filed: Apr. 3, 1996

[30] Foreign Application Priority Data

Apr. 13, 1995 [GB] United Kingdom ..... 9507717

[51] Int. Cl.[6] ..... H01Q 13/10

[52] U.S. Cl. ..... 343/770; 343/700 MS; 343/846

[58] Field of Search ..... 343/700 MS, 767, 343/770, 768, 846, 848; H01Q 1/38, 13/10

[56] References Cited

U.S. PATENT DOCUMENTS 4,977,406 12/1990 Tsukamoto et al. ..... 343/700 MS 5,453,751 9/1995 Tsukamoto et al. ..... 343/770

5,499,033 3/1996 Smith ..... 343/770

5,532,643 7/1996 Knuffner et al. ..... 343/700 MS

*Primary Examiner*—Donald T. Hajec

*Assistant Examiner*—Tan Ho

*Attorney, Agent, or Firm*—Lee, Mann, Smith, McWilliams, Sweeney & Ohlson

[57] ABSTRACT

A layered antenna having a linear array of radiating elements (11) is disclosed. Each radiating element comprises an aperture with one or more probes (16,18) which extend into the area defined by the apertures in two groundplanes parallel spaced from the probes and feed network (14) therefor. There is provided a reflecting backplane (28) which serves to reflect signals directed towards the backplane back toward the probes whereby the output signal in the primary radiating direction is reinforced. Flanges (30,32) depend from the apertured groundplane closest to the reflecting groundplane to isolate the radiating elements and thereby reduce coupling effects.

9 Claims, 2 Drawing Sheets

LAYERED ANTENNA

FIELD OF THE INVENTION

This invention relates to microstrip or triplate antennas (otherwise known as layered antennas) having a linear array of radiating apertures or elements.

BACKGROUND ART

A form of triplate antenna comprises a radiating elment including a pair of closely spaced correspondingly apertured ground planes with an interposed printed film circuit, electrically isolated from the ground planes, the film circuit providing excitation elements or probes within the areas of the apertures, to form dipoles, and a feed network for the dipoles. In an array antenna a plurality of such aperture/element configurations are spaced at regular intervals colinearly in the overall triplate structure. This antenna construction lends itself to a cheap yet effective construction for a linear array antenna such as may be utilised for a cellular telephone base station. Such an antenna is disclosed in our copending patent application Ser. No. 91 24291.7.

Another type of layered antenna array comprises a single aperture per radiating element. A still further type comprises a primary aperture with two secondary apertures placed on opposite sides of the primary aperture. The array may extend in a single direction 9*a* (linear array) or in two directions (a planar array). In order to increase output from the antenna in a primary radiating direction, the antenna may further comprise an unapertured ground plane placed parallel with and spaced from one of the apertured ground planes to form a rear reflector for the antenna. Signals transmitted by the antenna towards the backplane are re-radiated in a forward direction.

A problem with array antennas having such a reflecting backplane is the need to control coupling between apertures and the feed network. The feed network comprises microstrip tracks arranged on a substrate and acts to feed the patch or probe radiating elements. Ideally, the feed network couples only with the repective probes/radiating elements and does not couple with re-radiated signals received from the reflecting backplane. Careful design of the dimensions of the apertures and the elements coupled with the design of the electrical characteristics of the feed network for the elements can give a measure of control of coupling, but for some applications this is not effective.

SUMMARY OF THE INVENTION

According to the present invention there is provided a layered antenna comprising:

a) a feed network layer;

b) ground layers on respective opposite sides of the feed network layer;

c) a back layer placed parallel with and spaced from one of the ground layers to form a rear reflector of the antenna;

said antenna having a linear array of radiating elements comprising apertures defined through the groundplanes, wherein the apertures formed in the groundplane adjacent the backplane have flanges which extend towards the backplane, whereby coupling between signals reflected by the reflecting plane and the other radiating elements is reduced.

An antenna in accordance with another aspect of the invention can comprise a planar array of radiating elements. The flanges need only be formed along the edges of adjacent apetures. The backplane may be arranged with flanges either side of the length of the array. When the aray is two dimensional, then it is preferred that the flange extend along all edges of each aperture. For convenience, however, adjacent columns may be arranged with two oppositely directed flanges, whereby the effect is the same. The groundplanes may be formed from aluminium. Alternatively, the groundplanes may be formed from a plastic moulding which has been metallised.

In accordance with a yet further aspect of the invention, there is also provided a method of receiving and transmitting radio signals in a cellular arrangement including an antenna comprising a linear or planar layered array of apertured radiating elements wherein the apertures adjacent a reflecting groundplane are shaped so as to isolate coupling due to the reflections from one radiating element coupling with another radiating element.

DESCRIPTION OF THE DRAWINGS

Embodiments of the invention will now be described with reference to the accompanying drawings in which.

Figure 1:
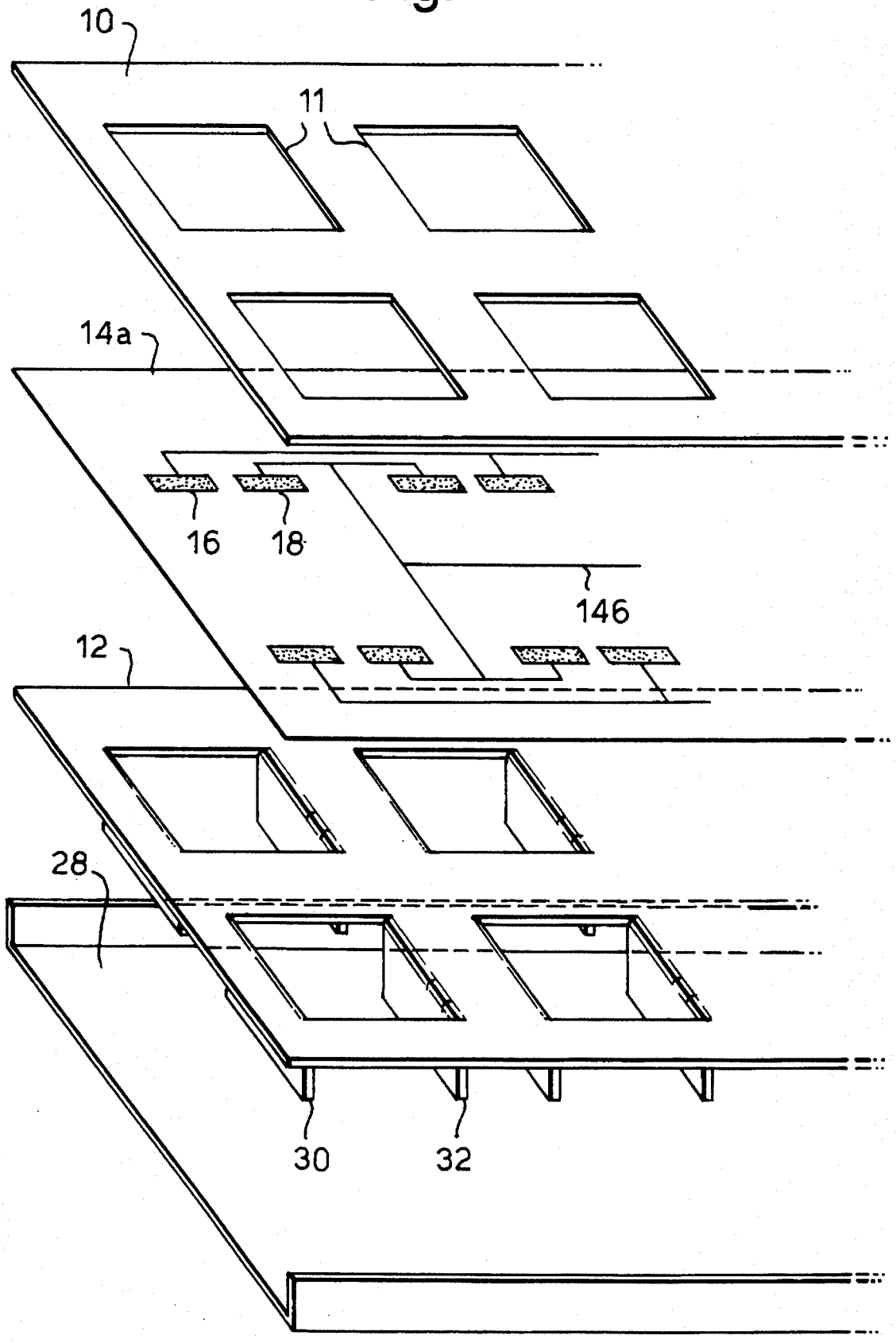
FIG. 1 is a perspective section view of part of a triplate linear antenna.

The array antenna is constructed of a first apertured metal or groundplane 10, a second metal or ground plane 12 and an interposed film circuit 14. Conveniently the planes 10 and 12 are thin metal sheets, e.g. of aluminium, which are initially flat, as shown in FIG. 1, and have substantially identical arrays of apertures 11 formed therein by, e.g. press punching. In the embodiment shown the apertures are rectangular and formed as a single linear array. Each array element comprises two adjacent apertures. The film circuit 14 comprises a printed copper circuit pattern 14*a* on a thin dielectric film 14*b*. When sandwiched between the apertured groundplanes part of the copper pattern 14*a* provides probes 16, 18 which extend into the areas of the apertures. The probes are electrically connected to a common feed point by the remainder of the printed circuit pattern which forms a feed conductor network in a conventional manner. In the embodiment shown the totality of probes in the array form a vertically polarised antenna when the linear array is positioned vertically. In a conventional triplate structure the film circuit is located between and spaced from the ground planes by sheets of foamed dielectric material (not shown). Alternative mechanical means for maintaining the separation of the feed conductor network may be employed, especially if the feed network is supported on a rigid dielectric. There is provided a flat, unapertured groundplane 28, e.g. a metal plate, acting as a reflector situated at a distance behind the array.

The antenna can also be fabricated using ground planes which have already been shaped e.g. aluminium groundplanes that have been shaped about a desired axis by stamping or otherwise. These pre-formed groundplanes are then connected together with the antenna feed network placed betwen in a spaced apart relationship. If the feed network comprises a dielectric film or sheet with a circuit printed thereon, then dielectric spacers such as plastics foam sheets may be used to maintain the feed network correctly spaced from the ground planes. Alternatively, the groundplanes could be formed of a moulded plastics material to which is applied a metallic coating.

In use the antenna functions in a similar fashion to an ordinary antenna. When the antenna transmits, radio signals are fed to the antenna feed network 14*a* by, for example, coaxial wires from a base station controller, via diplexers and amplifiers. The feed network divides so that probes 16 and 18 radiate within the areas defined by the apertures 11. The probes also radiate signals toward the reflecting backplane 28. These signals are then reflected back through the aperture 11, so as to increase the forward gain of the antenna. Flanges 30,32 formed on the edges of the lower groundplane serve to islolate the signals so that they do not interfere with other radiating elements.

Figure 2:
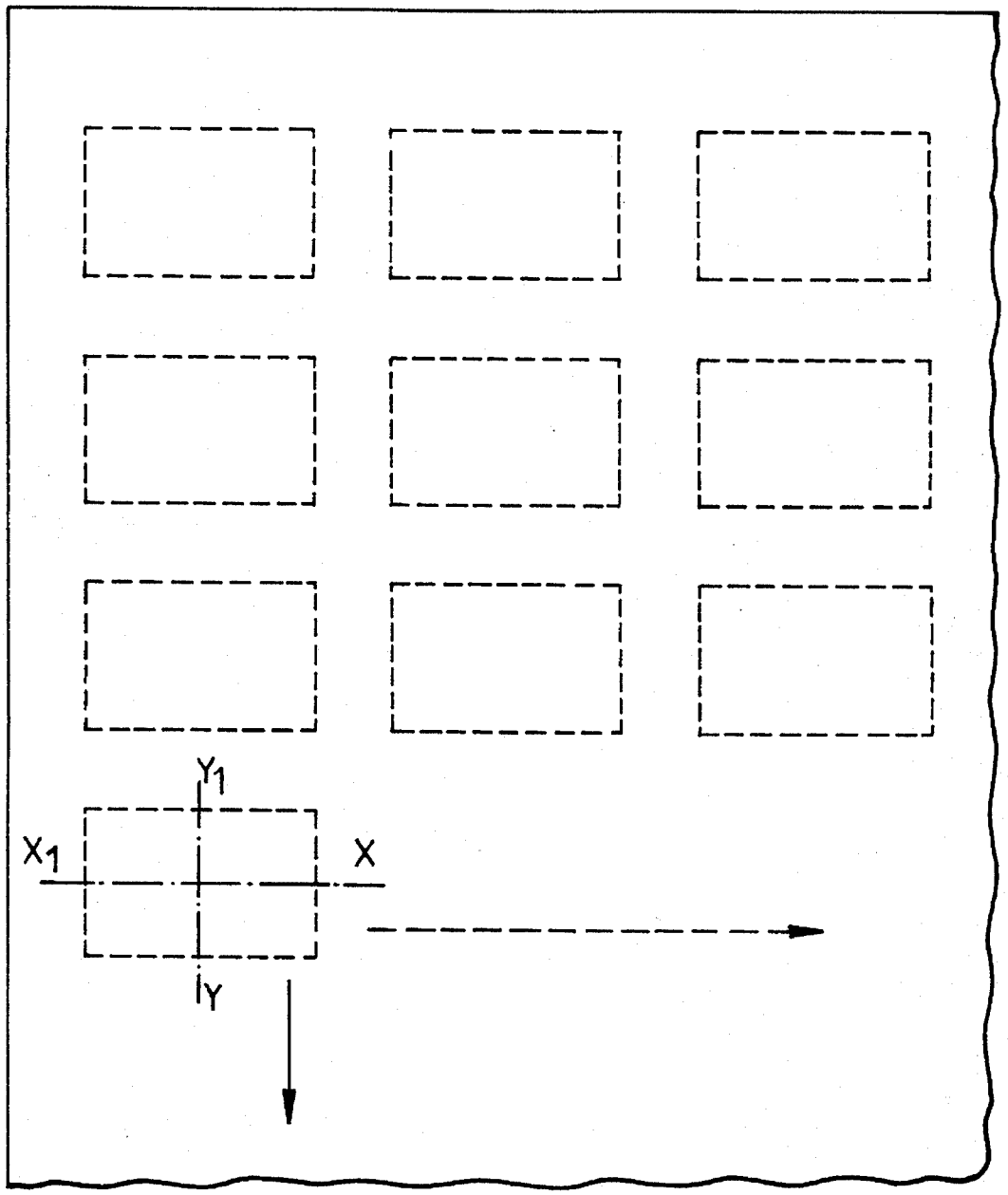
FIG. 2 is a plan view of part of a triplate planar antenna.
Figure 3:
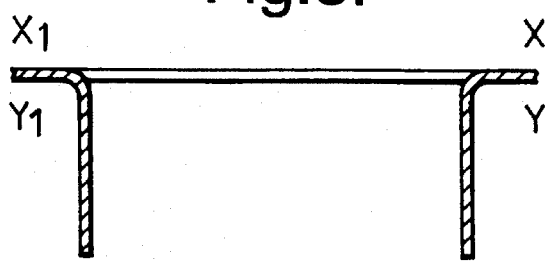
FIG. 3 is a cross-sectional view through an aperture of FIG. 2.
Figure 4:
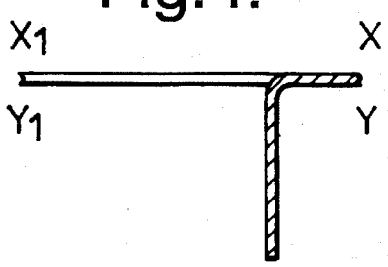
FIG. 4 is an alternative cross-sectional view through an aperture of FIG. 2.

FIG. 2 shows a second type of layered antenna having a two dimensional array wherein the flanges 30,32 associated with the lower groundplane depend from each edge of the aperture. FIG. 3 details the flanges in cross-section of an aperture. FIG. 4 shows an alternative wherein the flange depend only from two adjacent sides of an aperture.

I claim:

1. A layered antenna comprising:

a) a feed network layer;

b) groundplanes on respective opposite sides of the feed network layer;

c) a backplane placed parallel with and spaced from one of the ground layers to form a rear reflector of the antenna; said antenna having a linear array of radiating elements comprising apertures defined through the groundplanes, wherein the apertures formed in the groundplane adjacent the backplane have flanges which extend towards the backplane, whereby coupling between signals reflected by the reflector plane and the radiating elements is reduced.

2. A layered antenna according to claim 1 wherein the flanges are formed along the edges of adjacent apetures.

3. A layered antenna according to claim 1 wherein the backplane is provided with flanges either side of the length of the array.

4. A layered array according to claim 1 wherein the groundplanes are formed from plastic mouldings which have been metallised.

5. A layered array according to claim 1 wherein the groundplanes are formed from sheet aluminium.

6. A layered antenna comprising:

a) a feed network layer;

b) groundplanes on respective opposite sides of the feed network layer;

c) a backplane placed parallel with and spaced from one of the ground layers to form a rear reflector of the antenna;

said antenna having a planar array of radiating elements comprising apertures defined through the groundplanes, wherein the apertures formed in the groundplane adjacent the backplane have flanges which extend towards the backplane, whereby coupling between signals reflected by the reflector and the radiating elements is reduced.

7. A layered antenna according to claim 6 wherein the flanges are formed along the edges of adjacent apetures.

8. A layered array according to claim 6 wherein the groundplanes are formed from plastic mouldings which have been metallised.

9. A layered array according to claim 6 wherein the groundplanes are formed from sheet aluminium.

* * * * *